US006695028B1

(12) United States Patent
Scheuber et al.

(10) Patent No.: US 6,695,028 B1
(45) **Date of Patent: *Feb. 24, 2004**

(54) METHOD AND APPARATUS FOR PROVIDING TEXT ON PRINTED PRODUCTS

(75) Inventors: Markus Scheuber, Weisslingen (CH); Hans Frei, Oetwil am See (CH)

(73) Assignee: Ferag AG, Hinwil (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 220 days.

(21) Appl. No.: 09/078,914

(22) Filed: May 14, 1998

(30) Foreign Application Priority Data

May 16, 1997 (CH) ..... 1150/97

(51) Int. Cl.[7] ..... B65C 9/02; B65C 9/18; B65C 9/46

(52) U.S. Cl. ..... 156/387; 156/264; 156/277; 156/388; 156/521; 156/539; 156/566; 156/DIG. 25; 156/DIG. 33; 156/DIG. 47

(58) Field of Search ..... 156/256, 264, 156/277, 521, 566, DIG. 2, DIG. 25, DIG. 33, DIG. 34, DIG. 49, DIG. 47, 387, 388, 539

(56) References Cited

U.S. PATENT DOCUMENTS

| | | | | |
|---|---|---|---|---|
| 2,084,026 | A | | 6/1937 | Gurwick |
| 2,715,975 | A | * | 8/1955 | Doane et al. |
| 3,149,711 | A | | 9/1964 | Wolowitz |
| 3,282,720 | A | | 11/1966 | Oleksiw |
| 3,883,385 | A | * | 5/1975 | Kirk et al. |
| 4,004,058 | A | * | 1/1977 | Buros et al. |
| 4,149,711 | A | | 4/1979 | Jackson |
| 4,283,731 | A | | 8/1981 | Bok et al. |
| 4,421,587 | A | * | 12/1983 | Guenther et al. ..... 156/256 |
| 4,479,643 | A | * | 10/1984 | Seidel |
| 4,505,497 | A | | 3/1985 | Katzman |
| 4,538,161 | A | | 8/1985 | Reist |
| 4,706,877 | A | * | 11/1987 | Jenkins |
| 4,872,706 | A | * | 10/1989 | Brewen et al. |
| 4,932,647 | A | * | 6/1990 | Svensson |
| 4,983,990 | A | | 1/1991 | Fröhlich |
| 5,007,663 | A | * | 4/1991 | Moran |
| 5,373,350 | A | | 12/1994 | Taylor et al. |
| 5,407,718 | A | * | 4/1995 | Popat et al. |
| 5,514,860 | A | * | 5/1996 | Berson |
| 5,596,932 | A | | 1/1997 | Honegger |
| 5,688,058 | A | | 11/1997 | Honegger |
| 5,746,451 | A | * | 5/1998 | Weyer |
| 5,922,169 | A | * | 7/1999 | Chodacki et al. |
| 5,933,578 | A | | 8/1999 | Van de Capelle et al. |
| 6,063,229 | A | * | 5/2000 | Miles et al. |

FOREIGN PATENT DOCUMENTS

| | | |
|---|---|---|
| EP | 0 602 251 | 6/1994 |
| EP | 0 709 218 | 5/1996 |
| GB | 2 307 458 | 5/1997 |

OTHER PUBLICATIONS

Patent Abstracts of Japan, Publication No. 07290001; Publication Date Nov. 7, 1995; Application Date Apr. 26, 1994, Application No. 06088255.

* cited by examiner

*Primary Examiner*—Curtis Mayes
(74) *Attorney, Agent, or Firm*—Alston & Bird LLP

(57) ABSTRACT

A conveyor system conveys a plurality of printed products along a path of travel in an imbricated stream and such that a border region of each printed product is exposed by the imbricated overlap. A contrast panel (14), which forms a text panel (12), is applied to the exposed border region of each printed product (10). The contrast panel is provided with the text (18) and the contrast panel forms a contrast with respect to the text (18), with the result that the latter can be immediately seen and read easily. In one embodiment, the contrast panel is applied by printing, and in another embodiment, the contrast panel comprises a separate label which is adhesively applied.

2 Claims, 5 Drawing Sheets

Fig.4
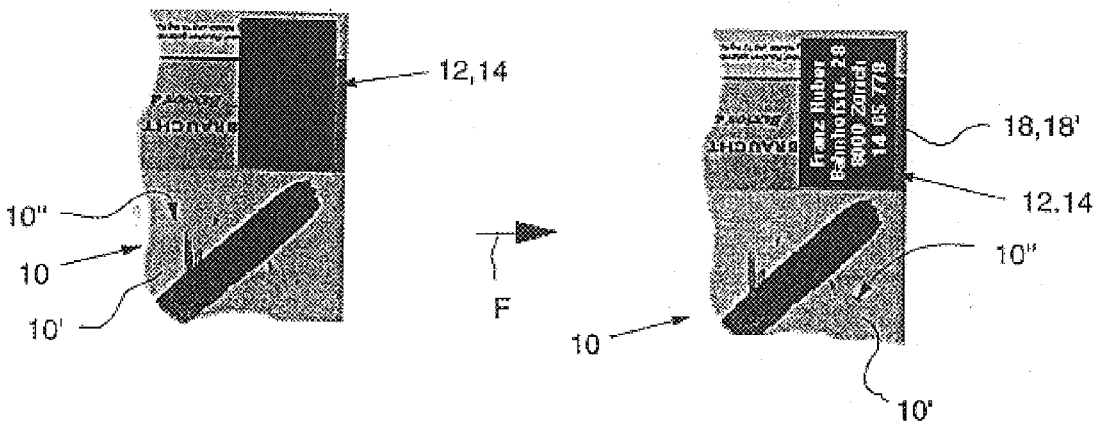
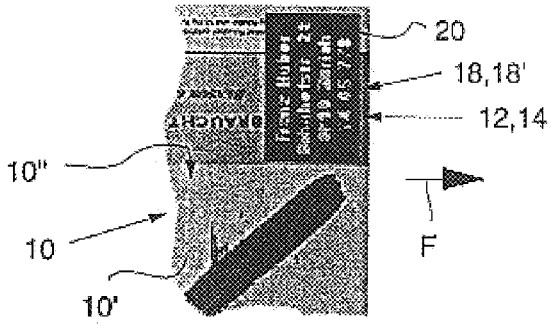
Fig.5

METHOD AND APPARATUS FOR PROVIDING TEXT ON PRINTED PRODUCTS

BACKGROUND OF THE INVENTION

The present invention relates to a method of providing text on printed products, and to an apparatus for implementing the method.

EP-A-0 096 228 and the corresponding U.S. Pat. No. 4,538,161 disclose an arrangement for addressing newspapers, periodicals and similar printed products. The arrangement has a conveying system which is designed as a unit conveyor and which has clamps which are arranged at intervals one behind the other, and with the clamps each being configured to grip one printed product. The conveying system guides the printed products past a stationary ink-jet printer. A clock generator is provided which is driven by the unit conveyor and which emits a control signal for each clamp. The control signal triggers in each case one printing operation of the printer when a printed product passes through the printing region of the printer.

A method of, and an apparatus for, providing text on printed products are also known from EP-A-0 709 218. In this apparatus, a conveying system moves the printed products, which overlap one another in an imbricated manner, past a first printing station in the conveying direction. The printing station applies text to the outer side of the printed products which is directed towards it, in a text panel which is arranged in the border region which is exposed by the imbricated overlap. Before the printed products are guided past a second printing station, a border region of the second outer side of the printed products is exposed, for example by being turned over. The second printing station then provides text on printed products in a further text panel in the border region of the second outer side.

A further method of, and an apparatus for, providing text on an inner side of folded printed products are disclosed in EP-A-0 709 326 and in a corresponding U.S. Pat. No. 5,596,932. In this case, the printed products are transported with their fold, which runs approximately at right angles to the conveying direction, retained by means of clamps. An opening device moves the front and rear halves of the respective folded printed products apart from one another, with the result that a printing head can carry out the desired text-applying operation on the inner side of the folded printed product.

These known methods and apparatuses are suitable, in particular, for providing text on printed products in a border region which does not contain any printing. If the text or part thereof is located in the printed region of the printed products, there can be problems as far as the clarity and legibility of the information are concerned.

It is thus an object of the present invention to develop the method of the described type such that the information which is to be applied to the printed products can be seen and read easily in all circumstances. It is also an object of the present invention to provide apparatuses which are particularly suitable for implementing the method according to the invention.

SUMMARY OF THE INVENTION

The above and other objects and advantages of the present invention are achieved by the provision of a method and apparatus wherein the printed products are conveyed in an overlapping imbricated stream and such that a border region of each printed product is exposed by the imbricated overlap. A contrast panel, which forms a text panel, is applied to the exposed border region of each printed product, and the contrast panel forms a contrast with respect to the information which is to be applied. This ensures that the information always appears in contrast with respect to its surroundings and can thus be seen and read easily.

The method according to the invention is suitable, in particular, for providing text on printed products which are produced by means of gravure printing. In the case of these printed products, the printed information often extends right up to the border of the printed sheets. The application of a contrast panel, which forms the text panel, allows the information to be seen and read easily, even when the printed information is of the same color as the text or is of a color which does not form much of a contrast with respect to the text.

A particularly preferred embodiment of the method according to the invention utilizes a contrast panel which is partially transparent. Such a panel forms a good contrast with respect to the information and also allows the printed information of the printed product to be seen and read when the contrast panel overlaps the printed information.

BRIEF DESCRIPTION OF THE DRAWINGS

The present invention will now be explained in more detail with reference to exemplary embodiments illustrated in the drawings, in which, purely schematically:

FIG. 4 shows, in the same illustration as FIG. 1, the printed product, on the left, with a contrast panel applied using dark ink and, on the right, with text applied in the contrast panel using light-colored ink;

FIG. 5 shows part of the printed product with a contrast panel applied using dark ink, the characters which form the text having been left blank as the contrast panel was produced;

DETAILED DESCRIPTION OF THE PREFERRED EMBODIMENTS

Figure 1:
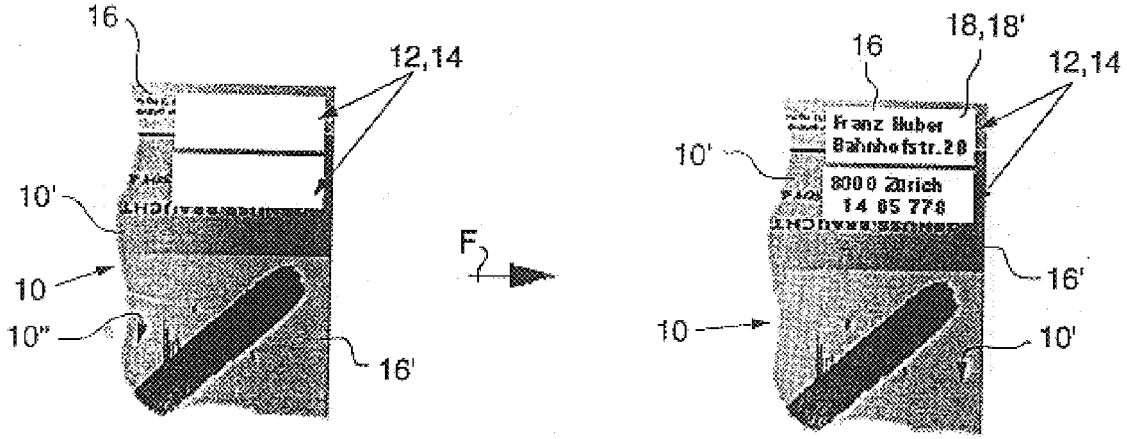
FIG. 1 shows, on the left, part of a printed product to which, in a first step, two light-colored contrast panels have been applied and, on the right, the same part of the printed product, which, in a second step, has been provided with dark text in the contrast panels.

FIG. 1 shows a corner region of a printed product 10 which is transported continuously in the conveying direction F, said printed product being shown, on the left, after a first step and, on the right, after a second step for providing it with text. As is illustrated on the left in FIG. 1, a surface 10" of the printed product 10, said surface being printed with printed information 10', has been provided, in the first step, with two contrast panels 14, which form a text panel 12. The text panels 12, which are arranged one beside the other, are of rectangular shape, the longer sides running in the conveying direction F. The printed product 10 is printed right up to its borders 16, 16', the printed information 10' in the region of the text panels 12 being covered over by the contrast panel 14, which has been printed on using light-colored, preferably white, ink.

In a second step, the text panels 12 have been provided with information 18', in the present example with an address. The information 18' is printed onto the white contrast panel 14 using dark, preferably black, ink, see the printed product 10 illustrated on the right in FIG. 1. The contrast panel 14 forms a contrast with respect to the text 18, with the result that the latter can be immediately seen and read easily. Moreover, the text panel 12 forms a contrast with respect to the printed information of the printed product.

Figure 2:
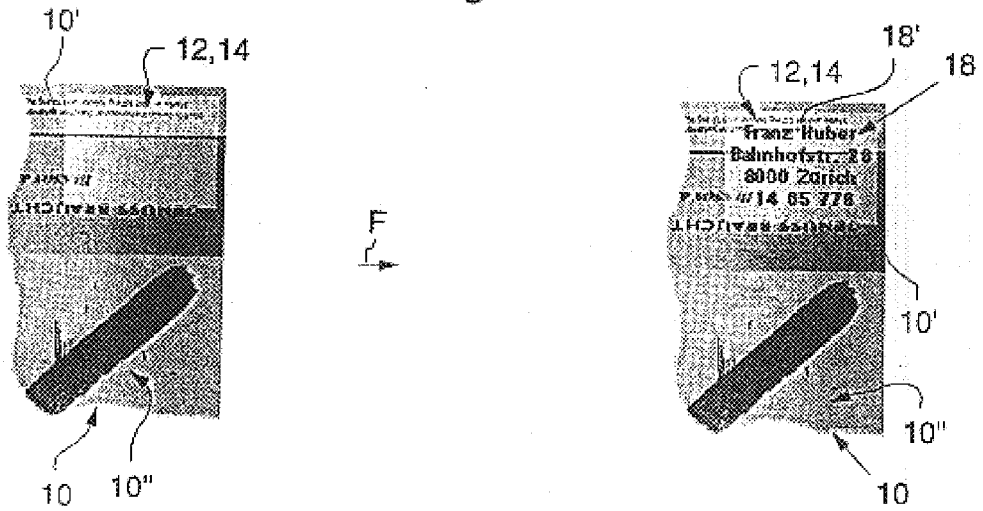
FIG. 2 shows, in the same illustration as FIG. 1, the printed product parts, on the left, with a partially transparent contrast panel applied and, on the right, with dark text in the contrast panel, the contrast panel and the text running in the conveying direction of the printed product.

The printed product 10 which is shown on the left in FIG. 2 has been provided with a partially transparent contrast panel 14, which forms the text panel 12. The printed information 10' can also be seen in the contrast panel 14. It has proven particularly advantageous to print using partially transparent white ink; the latter has a milky white appearance and the printed information 10' can easily be seen through it. The printed product 10 which is shown on the right of FIG. 2 is provided, in the partially transparent contrast panel 14, with the information 18', which forms the text 18, using dark, preferably black, ink. Tests have shown that, even on printed products 10 which have been printed using black ink and have a partially transparent light-colored contrast panel, black text 18 can be read easily without the printed information 10' being obliterated. In the case of the example shown in FIG. 2, the contrast panel 14 is likewise rectangular, and the longer sides likewise run in the conveying direction F.

Figure 3:
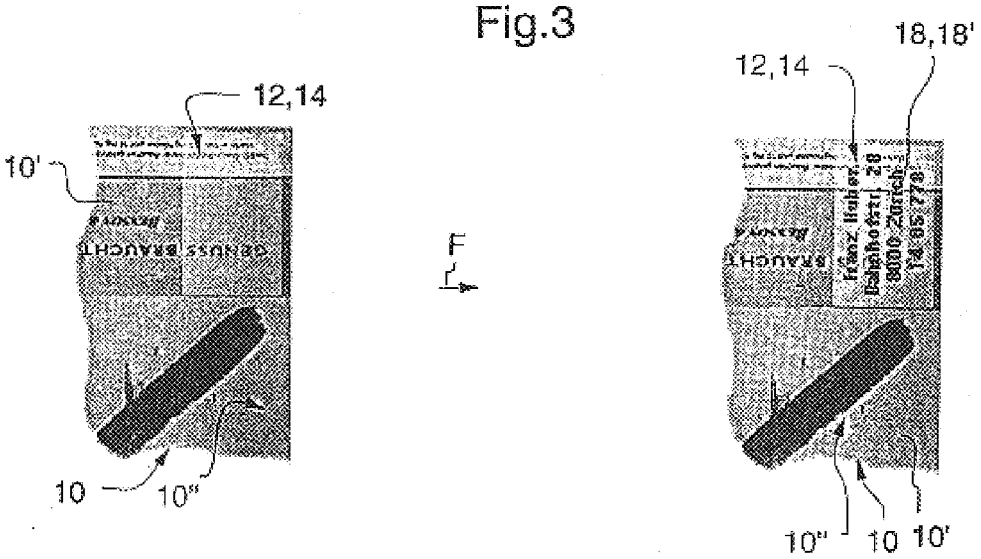
FIG. 3 shows the printed product part, on the left, with a partially transparent contrast panel applied and, on the right, with dark text in the contrast panel, the contrast panel and the text running transversely with respect to the conveying direction.

FIG. 3 shows, on the left, the corner region of the printed product 10 with a printed-on contrast panel 14 which is likewise partially transparent and, on the right, the printed product 10 with black text 18 in the partially transparent contrast panel 14, analogously to FIG. 2. In FIG. 3, the rectangular contrast panel 14 is arranged such that its longer sides run at right angles to the conveying direction F.

FIG. 4 shows, on the left, the printed product 10 with a dark, preferably black, contrast panel 14 applied in the first step. As FIG. 4 shows on the right, the information 18', which forms the text 18, has then been printed onto the printed product 10 in the contrast panel 14, in the second step, using light-colored, preferably white, ink.

In the case of the printed product 10 which is shown in FIG. 5, the contrast panel 14, which forms the text panel 12, and the text 18 have been produced in a single step. The characters 20 which form the information 18' were left blank as the contrast panel 14 was applied. Here too, the contrast panel 14 forms a contrast with respect to the printed information 10' in the region of the contrast panel 14.

Figure 6:
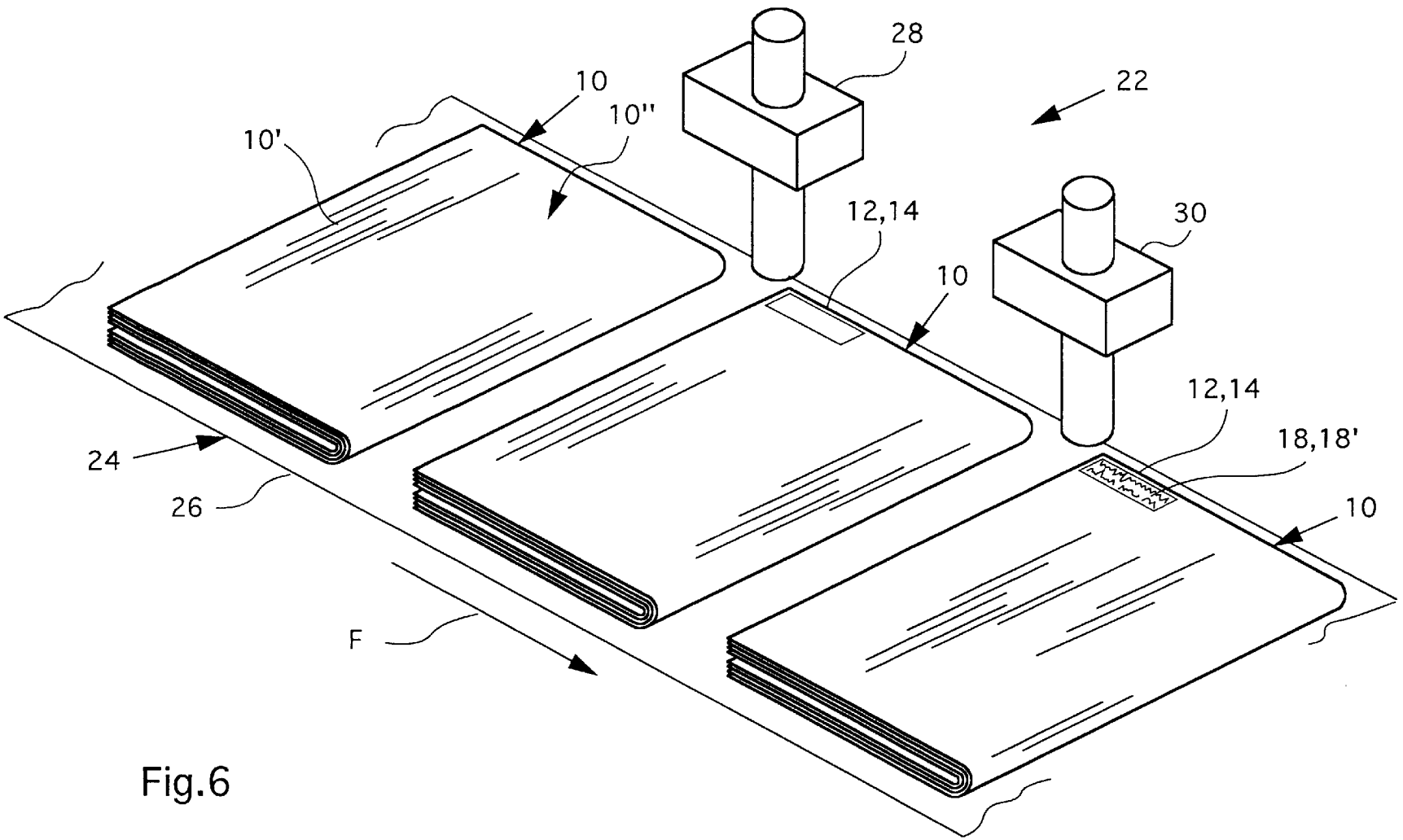
FIG. 6 shows a perspective illustration of an apparatus having a conveying means designed as a belt conveyor, and having two printing stations for applying a contrast panel to the printed products and for providing text on the printed products in the contrast panel.

FIG. 6 shows a perspective illustration of a first embodiment of an apparatus 22 for the inventive operation of providing text on the printed products 10 according to FIGS. 1 to 5. The apparatus has a conveying means 24 with a belt conveyor 26 which is driven so as to circulate continuously in the conveying direction F. The multi-part, folded printed products 10, for example newspapers, periodicals or the like, are spaced apart from one another on the belt conveyor 26. Two printing stations 28, 30 are arranged above the belt conveyor 26 and spaced apart from one another in the conveying direction F. The first printing station 28, as seen in the conveying direction F, is intended for printing a contrast panel 14 onto a corner region of the printed surface 10" of each printed product 10 which is moved past it. The second printing station 30, which is arranged downstream of the first printing station 28, is intended for printing the printed-product-specific information 18', for example an address, a number, a bar code or the like, into the contrast panel 14 of the printed products 10 which are moved past it. Of course, the colors of the inks applied by means of the first printing station 28 and by means of the second printing station 30 form a contrast.

If the printed products 10 are to be provided with text according to FIG. 5, either one of the two printing stations 28, 30 is brought to a standstill or the apparatus 22 has only one printing station 28.

Figure 7:
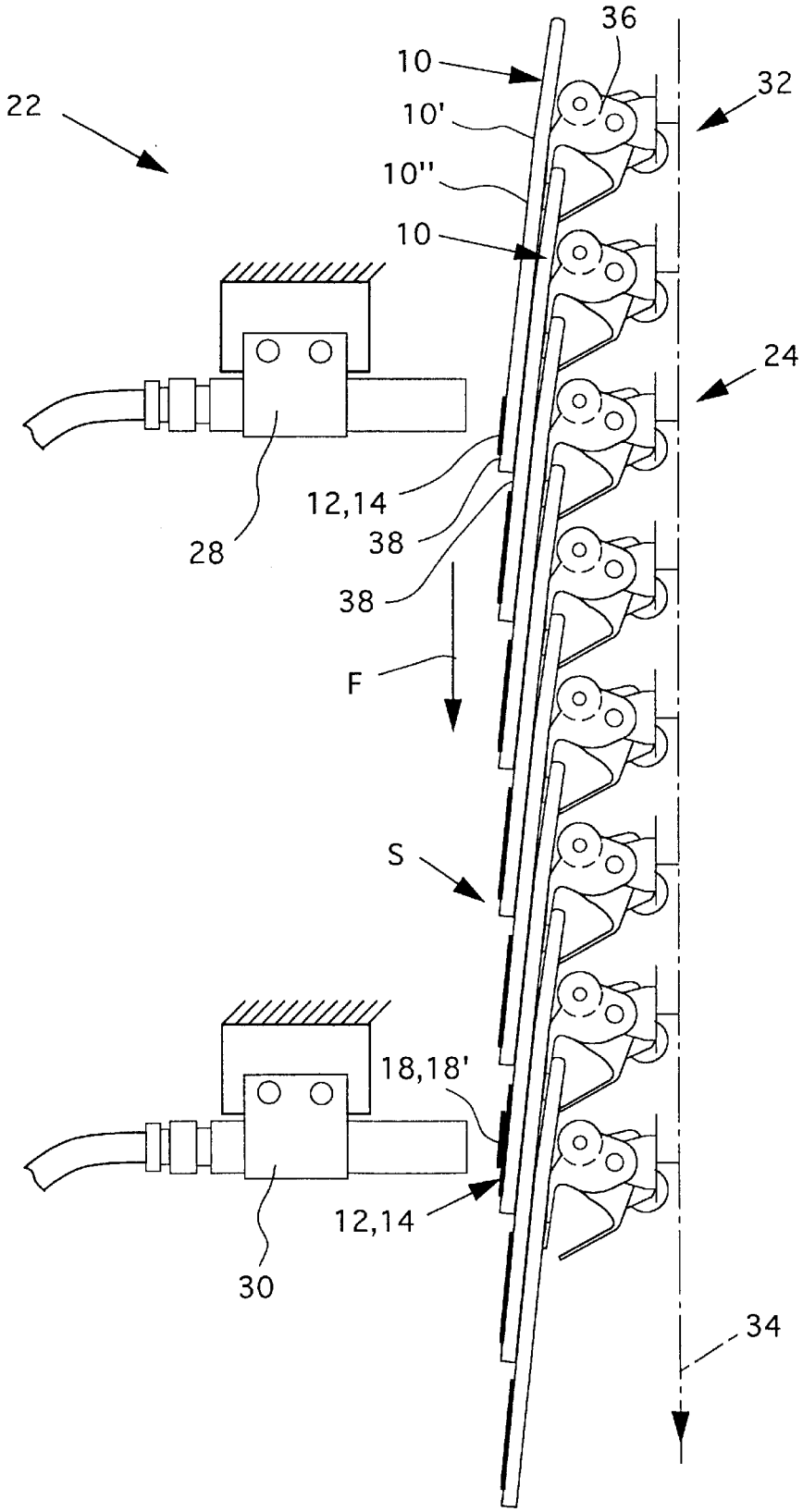
FIG. 7 shows a view of an apparatus with a conveying means which is designed as a clamp-type transporter and is intended for transporting the printed products, and having two printing stations for applying a contrast panel to the printed products and for applying text to the contrast panel.

The apparatus 22 which is shown in FIG. 7 has a conveying means 24 which is designed as a clamp-type transporter 32. Arranged on a drawing member 34, which is driven continuously in the conveying direction F, are clamps 36, which are spaced apart one behind the other and can be controlled individually and are intended for retaining in each case one printed product 10. The printed products 10 rest against one another such that they overlap one another partially, forming an imbricated formation S in the process. Each of the printed products 10 thus has, on the side which is directed away from the drawing member 34, an exposed border region 38, which is not covered over by an adjacent printed product 10. Arranged opposite the drawing member 34, in relation to the movement path of the printed products 10, are two printing stations 28, 30, which are spaced apart from one another, as seen in the conveying direction F. The first printing station 28, as seen in the conveying direction F, is intended for printing a contrast panel 14, which forms the text panel 12, onto the border region 38 of the printed products 10 which are moved past it by means of the clamp-type transporter 32. The second printing station 30, which is arranged downstream of the first printing station 28, is intended for printing into the respective contrast panel 14 the information 18' which is assigned to the printed product 10.

Figure 8:
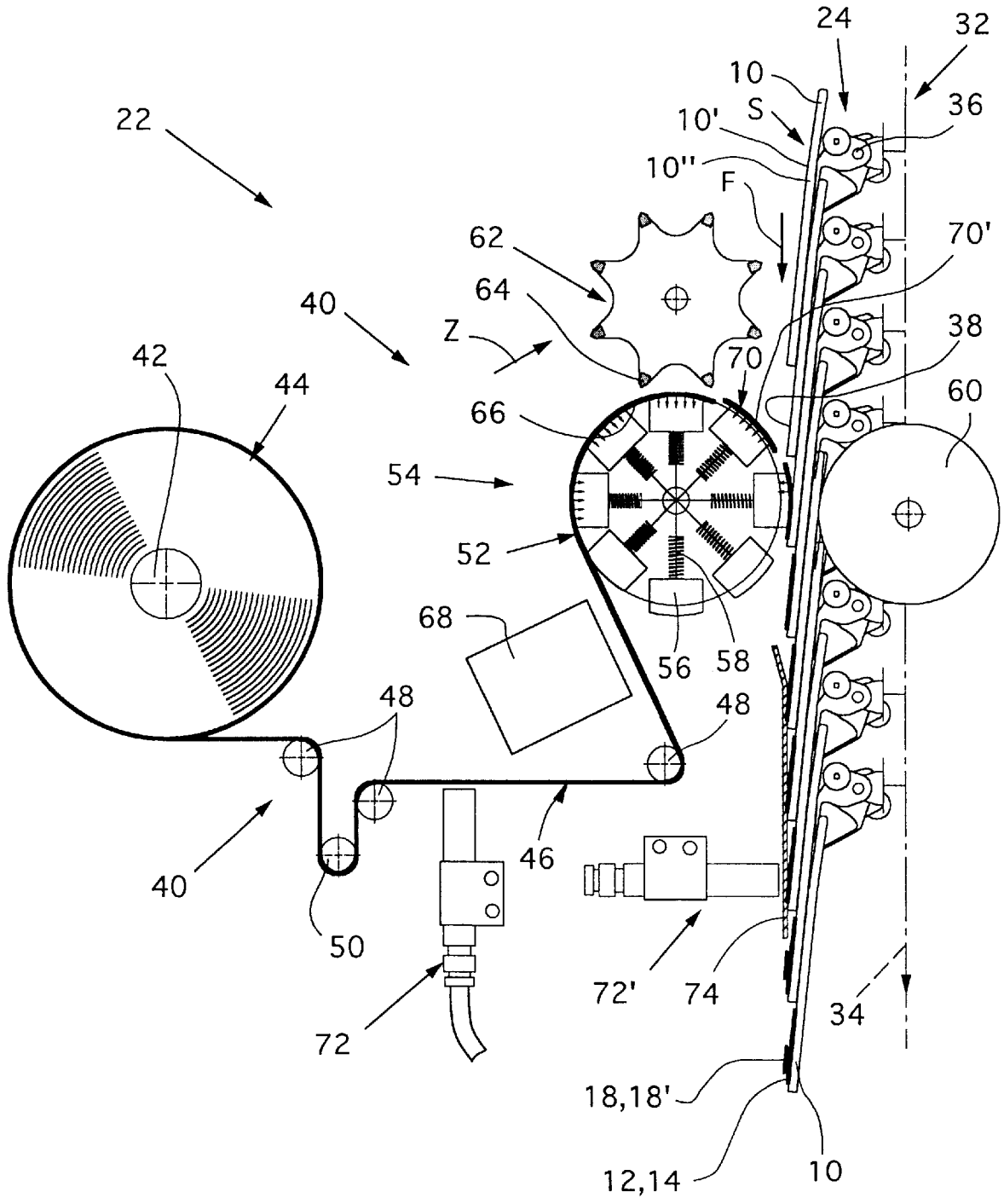
FIG. 8 shows a view of an apparatus having a conveying means which is designed as a clamp-type transporter and is intended for transporting the printed products, and having a labeling device for producing and adhesively bonding partially transparent labels, which form a contrast panel and are provided with text at a printing station.

The apparatus 22 which is shown in FIG. 8 likewise has a conveying means 24 which is designed as a clamp-type transporter 32, in the same way as that of FIG. 7. The apparatus 22 is also provided with a labeling device 40. The latter has a bearing arrangement 42 for receiving a supply roll 44 of a partially transparent strip 46. The strip 46 is guided, around deflecting rollers 48 and a tensioning roller 50, to an application wheel 52 of an application device 54. The application wheel 52, which is driven in rotation in the feed direction Z, has rams 56 which are distributed in the circumferential direction and can be retracted and extended in the radial direction. The rams 56 are prestressed outwards in the radial direction by means of springs 58 and, in one region of the circumferential path, are retained, for example by a guide means, counter to the spring force in a rest position, in which they are located in the inside in a radial direction. Each of the rams 56 is provided, on its radially outer side, with holes which, in dependence on the rotary position of the application wheel 52, are connected to a negative-pressure source (not shown). On the side which is located opposite the application wheel 52, in relation to the movement path of the printed products 10, the application device 54 has a freely rotatably mounted supporting wheel 60.

Furthermore, the labeling device 40 has a cutting wheel 62, which is of star-like design and whose cutting elements 64, which run parallel to the axis of rotation, are intended for interacting with mating surfaces 66 of the application wheel 52 between the rams 56.

Furthermore, provided between the bearing arrangement 42 and the application wheel 52 is an adhesive-application device 68, which is intended for applying adhesive to the radially outer side of the strip 46, as seen in relation to the application wheel 52.

The labeling device 40 is driven synchronously with respect to the conveying means 24 and is intended for providing each printed product 10, in the exposed border region 38, with a section 70 of the partially transparent strip 46, said section 70 forming a label 70'. This section 70 forms a text panel 12, which serves as a contrast panel 14. In order to provide text on the contrast panel 14, the apparatus has either a printing station 72, which is assigned to the labeling device 40, or a printing station 72', which is assigned to the conveying means 24. The printing station 72 is arranged between the bearing arrangement 42 and the application wheel 52 and is intended for applying text 18 to that side of the partially transparent strip 46 which is directed towards the application wheel 52. The printing station 72', which is arranged downstream of the application wheel 52, as seen in the conveying direction F, is intended, in the same way as the second printing station 30 of the apparatuses according to FIGS. 6 and 7, for printing the text 18 onto the contrast panel 14, which is formed by in each case one section 70 and is adhesively bonded to the relevant printed product 10. A guide 74, which is designed as a guide plate or guide bars, serves for stabilizing printed products 10 in the border region 38 while the text 18 is being printed on.

The labeling device 40 operates as follows. The strip, which rests against the application wheel 52 over part of the circumference of the latter is retained in that the relevant rams 56 are connected to the negative-pressure source. The strip 46 is drawn off from the supply roll 44 by virtue of the application wheel 52 being rotated in the feeder direction Z. Immediately before the strip 46 runs onto the application wheel 52, as seen in the feed direction Z, the relevant ram 56 is displaced into the radially inner, rest position and is then connected to the negative-pressure source. The cutting wheel 62 severs a section 70 from the strip 46 using in each case one cutting element 64, which interacts with the relevant mating surface 66. This section is retained by the relevant ram 56, which continues to be connected to the negative-pressure source. As soon as this ram 56 has left the region of the cutting wheel 62, the spring 58 displaces it, towards the outside in the radial direction, into the application position, as a result of which, as rotation continues, the section 70 which is retained by said ram, and has previously been provided with adhesive on the adhesive-application device 68, is applied to the border region 38 of the relevant printed product 10, and pressed thereon, by the ram. In the process, the openings in the ram 56 have air admitted to them, with the result that the section 70 is released. In this case, the supporting wheel 60 prevents the printed products 10 from being able to yield to the force of the rams 56.

Particularly suitable printing stations 28, 30, 72, 72' are those which use ink jet printing.

The method according to the invention may also be used to provide text on printed products which have surfaces which are barely suitable, if at all, for having text applied to them.

The contrast-panel-forming, self-adhesive, partially transparent labels may also be drawn off from a carrier strip and applied to the printed products.

The labels may be provided with an adhesive which makes it possible for them to be detached from the printed product.

What is claimed:

1. An apparatus for providing text on a printed surface having printing thereon of each of a plurality of printed products comprising:

a conveyor system for conveying the printed products along a path of travel in an overlapping imbricated stream and such that a border region of the printed surface of each printed product is exposed by the imbricated overlap;

label applying means disposed along the path of travel for applying a partially transparent contrast label to the exposed border region of each printed product so as to overlie the printing on the printed surface of the printed product and to allow the printing to be seen therethrough, said label applying means comprising means mounting a supply roll of a strip of partially transparent label forming material, a cutting system for withdrawing the strip from the supply roll and cutting the same into individual labels, and an application device for sequentially applying the individual labels onto the printed products; and printing means for printing information either onto the strip of partially transparent label forming material or onto each individual label, so that each individual label has the information printed thereon, and wherein the conveyor system comprises a plurality of clamps arranged one behind the other in the conveying direction for gripping respective ones of the printed products.

2. The apparatus as defined in claim 1 wherein the application device includes an adhesive applying device for applying an adhesive to the surface of the strip of partially transparent label forming material, and so that an adhesive is applied to the surface of each individual label which later engages the associated printed product.

* * * * *